United States Patent [19]

Leiter

[11] 4,385,707

[45] May 31, 1983

[54] COMPOSITE TIP-OFF CONTAINER CAP

[75] Inventor: L. David Leiter, Willow Grove, Pa.

[73] Assignee: The West Company, Phoenixville, Pa.

[21] Appl. No.: 276,974

[22] Filed: Jun. 24, 1981

[51] Int. Cl.[3] ..... B65D 41/42

[52] U.S. Cl. ..... 215/253; 215/303; 215/305

[58] Field of Search ..... 215/253, 249, 250, 251, 215/256, 295, 305, 302, 303, 304, 324, 325

[56] References Cited

U.S. PATENT DOCUMENTS

| | | | |
|---|---|---|---|
| 1,237,761 | 8/1917 | Dwyer | 215/325 |
| 1,711,232 | 4/1929 | Kimmel | 215/324 |
| 2,180,055 | 11/1939 | Hunt | 215/303 |
| 3,465,906 | 9/1969 | Wagner et al. | 215/253 |
| 4,105,133 | 8/1978 | La Barge et al. | 215/253 X |

*Primary Examiner*—Donald F. Norton
*Attorney, Agent, or Firm*—Eugene E. Renz, Jr.

[57] ABSTRACT

A composite tip-off type cap, and closure sealing means, operatively connected to a container for closure thereof and sealing of the contents therein. The composite cap includes a narrow elongated exterior top portion, a peripherally enlarged open bottom skirt at the bottom thereof, and a container access opening closure seal means, operatively disposed within the skirt and operatively integrated therewith. The integrated composite cap and closure seal means are conjointly removable from the container, to open the container for access to the liquid therein, by application of a lateral tilting force against the narrow, elongated cap exterior at a position thereof remote from connection of the cap to the container. Removal of the integrated cap and closure seal means from the container is effected without breakage of the material forming the container. The cap and closure seal means act as a unit assembly when being removed. The construction is designed to generally assimilate known glass ampules, in configuration, use, and to have a similar opening procedure.

8 Claims, 8 Drawing Figures

COMPOSITE TIP-OFF CONTAINER CAP

TECHNICAL FIELD

The invention relates generally to containers and cap closures therefor. The container can be a type adapted to contain a serum material, in the nature of a serum vial, and a composite cap therefor that allows the sealed vial to be opened in much the same manner as an all-glass ampule, but without any glass breakage. The cap design and structure allows for full removal of the cap and access closure seal means, such as a stopper, from a serum vial, or other container, prior to filling of a syringe from the vial.

The invention is principally directed to containers, and closures, of small sizes, such as for single dose medications for oral use, serums, liquor bottles, single dose powder products, and other single use products. Larger sizes of containers are contemplated within the invention, appropriate dimensions to be used.

The containers and their composite caps are designed primarily to be non-reusable, inexpensive, security proficient, and safe in operation of removal of the closure and sealing means from the body of the container, in the absence of container breakage.

BACKGROUND OF THE INVENTION

Numerous types of containers, in combination with sealing caps therefor, have heretofore been devised, and some have provided for ease of removal of the closing and sealing cap from the container.

The containers and their closure caps can be constructed of different materials, and the specific structures differ substantially, as regards the intercoaction of stopper and sealing means with access openings for the containers.

Different types of containers, having different types of closures, and adapted to contain small quantities of materials are found in numerous different specific forms and configurations. The manner in which the containers are opened is of substantial significance, especially in regards to those containers adapted for use in the medical field for containment of medicines, serums or the like. In addition to ease of opening, the structures must insure against breakage and/or contamination of the contents of the container.

Some such combination containers and closures have not fully met the requirements or desires of users in various usage fields. Some of the prior constructions have been complicated and expensive in construction. Other constructions have introduced problems of breakage when opening for access to the contents thereof.

Principally, the present invention is directed to a closure cap and sealing means for containers which will permit integral removal of the cap and a closure seal from, for example, a serum vial, prior to filling of a syringe from the vial, or other types of containers requiring ease of, and safe removal of, the caps from the containers.

The present invention has the capability of broad areas of use but, principally, the invention is directed to a new type of metal, or metal/plastic, cap which, when sealed to a container in the nature of a serum vial, allows the so-closed and sealed vial to be opened easily, rapidly, and with a substantial guarantee of the absence of breakage of the container material. Other obvious uses of the concepts and teachings of the invention will be readily apparent.

While the present invention will be specifically described in preferred constructional forms, the invention, obviously, is not limited as regards function and/or the specifics of the construction. Variations in use, and specifics of constructional details and materials, will be obvious and within the scope of the invention.

As will be noted in the following detailed description, and disclosure of preferred embodiments of the invention, specifically different forms and details are provided on the disclosed embodiments, and variations within the scope of the invention can be effected.

SUMMARY OF THE INVENTION

The present invention is broadly directed to a composite tip-off type cap and closure means for operatively closing and sealing an access opening of a container.

The composite includes a sealing stopper member, which is cooperatively engagable with the access opening in a fluid sealing relation therewith, and a cap or cap portion, to facilitate container opening.

The cap consists of an upper, elongated tubular configuration having an open bottom end. Proximate and above the open bottom end there is peripherally enlarged outer hollow skirt portion adapted for operative engagement over the stopper for the container, over and around the access opening thereof. The skirt portion is frictionally and detachably mechanically engaged with, and surrounds, the container exterior about the access opening. The skirt portion encloses and positionally maintains the stopper in closing and sealing engagement with the access opening.

The composite cap and sealing means are conjointly removable from the container as an integrated unit, to expose the access opening, by application of a lateral force proximate the upper end of the elongated cap portion structure, with a resultant angular tilting, or tipping, of the cap. This serves to disengage the composite cap structure from the container for access to the contents therein.

Other objects and advantages of the present invention will become readily apparent to those skilled in the art from the following detailed description, wherein there are shown and described preferred embodiments of the invention, simply by way of illustration of currently preferred and contemplated modes for carrying out the invention. As will be realized, the invention is capable of other and specific embodiments, and its several details are capable of modification in various, obvious respects, all without departing from the invention. Accordingly, the drawings and description are to be regarded merely as illustrative in nature, and not as restrictive.

BRIEF DESCRIPTION OF THE DRAWINGS

The accompanying drawings illustrate preferred embodiments of the invention and, when taken together with the description, serve to explain the principles and structure of the invention.

In the drawings.

DETAILED DESCRIPTION OF PREFERRED EMBODIMENTS

Figure 1:
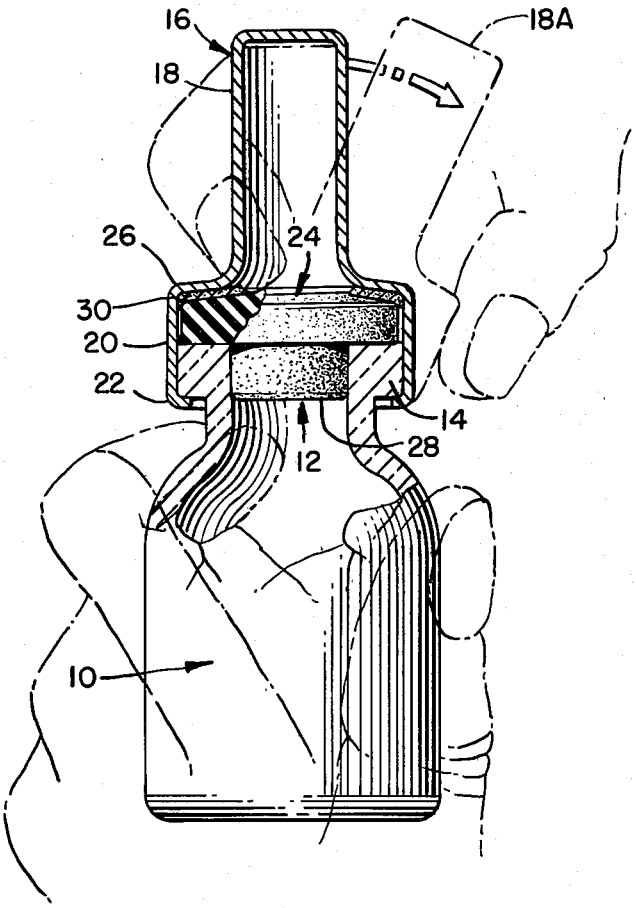
FIG. 1 is an elevational, partial pictorial view, of an embodiment of the invention, and disclosing in broken lines a partially detached position of a composite cap and sealing means for the container, the closing and sealing condition being shown in full lines, and parts being broken away and in section, for disclosure of details.

The invention, and the principals thereof, are shown in the drawings and will be described with respect to incorporation or combination with a typical glass serum vial. This container, or vial, is designated generally at 10 in FIG. 1. The container, or vial, has the usual access opening where indicated by arrow 12 at its open top or end. In the absence of a stopper or seal over the opening, access to the contents of the container is provided, regardless of the nature of the contents. Peripherally surrounding the access opening is the normal container finish 14, constituted in a known manner by a bead-like configuration.

The composite tip-off cap construction is generally indicated at 16. In the embodiment shown in FIG. 1, the cap is preferably of an all metal exterior construction and, as shown, includes an upper, tubular, elongated portion 18. Integrally formed with this tubular upper portion is a lower, peripherally enlarged, outer hollow skirt portion 20. The lower peripheral edge of the skirt portion 20 is adapted to be crimped around and under the lower surface of finish 14, as generally indicated at 22.

A typical type rubber stopper, or the like, 24 is inserted and contained within the lower skirt portion and includes an enlarged head at 26 of commensurate exterior dimensions with the interior dimensions of the skirt portion 20. The bottom 28 of the stopper is of a size to snugly and sealingly engage within the access opening 12 of container 10.

The composite tip-off cap construction shown in FIG. 1 is formed, prior to connection with the container 10, by inserting the head within the peripheral skirt, and operatively integrating the material of the stopper, or the like, to the material of the cap, such as by adhesive at the position generally indicated at 30. A typical structure would consist of a disc of hot-melt type applied to the top of the stopper head thereof, before application of, and crimping of, the lower peripheral edge of the skirt at 22.

Normally, in practice, the metal cap is shipped to the ultimate user with a disc of hot-melt film adhesive bonded to a washer-like underside of the cap, but without a stopper. The user will fill the container, seal it with a loose stopper, apply the combined cap/hot-melt sub-assembly, crimp the skirt of the cap and, lastly, bond the cap to the stopper by thermal activation of the hot-melt adhesive after the crimping operation.

In the embodiment shown in FIG. 1, the upper or exterior cap portion is preferably all metal, such as aluminum, although as will appear hereinafter, other materials can be utilized and different details of interconnection with sealing or stopper means are contemplated. A typical crimp, formed at 22, effectively interengages the various components of the tip-off cap with the container 10. The finalized, or finished, construction is shown in full lines in this view.

In phantom, or broken, lines 18A in FIG. 1, it is disclosed how the tip-off cap is pried off laterally by the hands of the user. This is accomplished generally by application of a lateral pressure, or force, against an upper area, or position of, the elongated cap portion 18. In essence, this removal is the same as utilized for the top or removable portion of a glass ampule, which is broken off by the force applied thereagainst. The cap's length serves as a moment arm or lever during removal.

Figure 3:
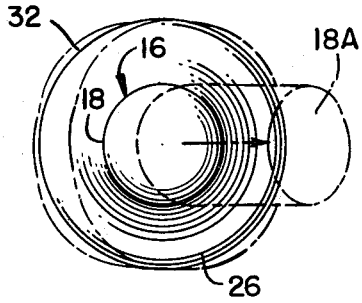
FIG. 3 is a top view of the cap with its position during removal shown by broken lines.

Removal of the composite cap, as indicated by the broken lines 18A, is accomplished by an uncurling action of parts of the crimped lower edge of the skirt portion (FIG. 3). The uncurling occurs during opening of the vial by force of the user's hands, multiplied by the mechanical advantage, or leverage, obtained due to the elongated upper tubular cap portion 18 in an obvious manner. Since the portion 18 and the stopper 24 are integrated as by the adhesive, as the tip-off cap is removed, the stopper is also removed with the lower, or plug, portion being retracted from the access opening and the tip-off cap is removed as a single, composite unit. A slight distortion of the crimped portion can take place (FIG. 3).

Obviously, with this construction, there is no likelihood of breakage of a typical glass serum vial, or one of other similar material. In essence therefore, the tip-off composite cap and closure means of the invention serves its normal function of closing and sealing a container, such as a frangible glass serum vial, and yet permits easy opening of the vial in a usual manner, by application of a force by a user's hands. The structure allows for the full removal of the cap and stopper from the vial to provide access to the contents of the vial. The possibility of glass or other material breakage, during this opening, is obviated, eliminating risk of cut fingers and/or glass particulate in the drug, with substantial pharmaceutical advantages. The design and functioning of the disclosed and described tip-off cap are quite simple. It is also to be noted that this construction opens just like the known glass ampules, primarily due to the tall, or elongated, upper section of the cap. The exterior cap portion can, of course, be manufactured in well known processes, and with known machinery. The stopper is of a known and used type.

Figure 2:
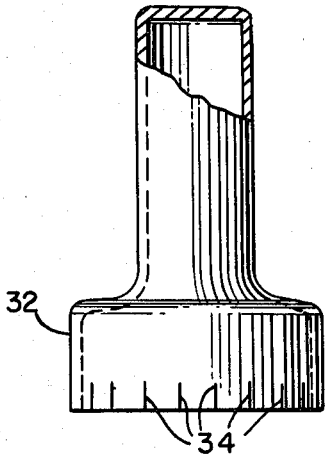
FIG. 2 is an elevational view of a modified form of tip-off cap having a scored skirt thereon.

FIG. 2 of the drawings shows a slightly modified form of the invention. In this view, the enlarged, peripheral skirt corresponding to the lower skirt portion 20 in FIG. 1, is designated 32, and a plurality of controlled scores 34, partially through the material, are provided in the lower edge of the skirt. These scores provide for ease of removal of the cap by lowering the tip-off force required laterally against the upper cap portion. The construction and operation are otherwise similar to that shown in FIG. 1.

Figure 4:
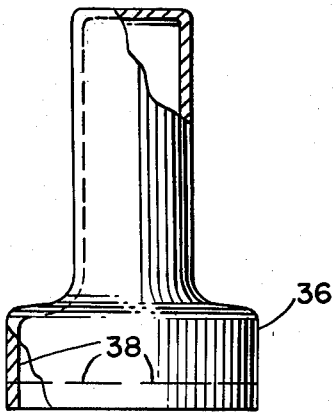
FIG. 4 is an elevational view of the tip-off cap, including tamper-evident means incorporated therein.

FIG. 4 discloses a further modified form of the cap exterior, wherein the skirt portion 36 has formed therein an interrupted circumferential score line, indicated at 38. This score line creates a tamper indicator crimp feature similar to well known features on screw-type caps. Functionally, when the composite cap is to be removed, and a lateral force is applied against the upper, elongated cap portion, the material of the skirt will break along this circumferential score line. Any attempts to reseal or conceal the fact of an opening of the vial will be visually, readily apparent in this form of construction.

Figure 5:
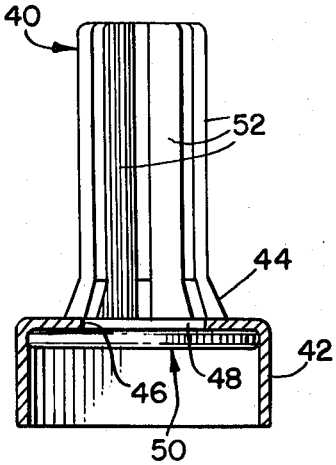
FIG. 5 is a side elevational view of a further embodiment of the tip-off cap, partially in section, of a two component metal-plastic version.
Figure 6:
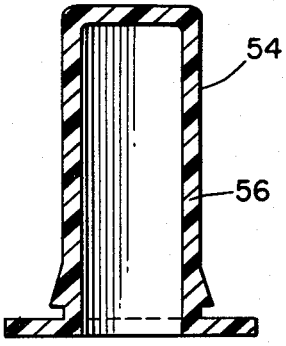
FIG. 6 is a sectional view through a plastic component of a modified form from that shown in FIG. 5.
Figure 7:
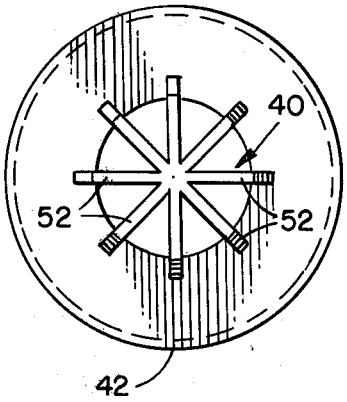
FIG. 7 is a top plan view of the tip-off cap construction of FIG. 5.

Additional modified forms of the invention are disclosed in FIGS. 5, 6, 7 and 8. Referring initially to FIGS. 5 and 7, a finned plastic insert member 40 is adapted for interengagement and connection with a metal peripheral lower skirts portion 42, preferably constituted of metal similar to that used in the embodiment of FIG. 1. The plastic portion 40 is similar in functional operation to upper, tubular, elongated cap portion 18 of FIG. 1. The plastic insert and skirt are locked together via a snap lip 44 in engagement with the inner edge 46 of a central opening 48 in the lower skirt portion 42. The skirt is of metal and can be effectively and simply drawn in cup form with a blanked center hole therethrough.

The plastic insert 40 has a full disc area 50 which permits, and is adapted for, a maximum operative integration, such as, for example, by an adhesive bonded contact with the top of a stopper, such as indicated at 24 in FIG. 1.

The plastic insert 40 has numerous, advantageous features in formation and operation of the invention. This portion includes a plurality of fins at 52. The member can be easily molded and color coding can be incorporated into the plastic. As noted above, a maximum bonding area with the stopper can be provided for, and a rapid mechanical "snap" assembly with the lower metal skirt portion can be accomplished. FIG. 7 shows a top plan view of FIG. 5, which in effect is a two-component, metal-plastic version of the tip-off cap.

This type or form shares many of the similarities of operation of the form of FIG. 1 and, additionally, can provide desirable features in, for example, attractive coloration and can be formed as an injection molded component. If desired, the scoring features shown in FIGS. 2 and 4 could be readily incorporated in the embodiment of FIG. 5.

A slightly modified embodiment is disclosed in FIG. 6. Basically, this is quite similar in most respects to the plastic insert 40 of FIG. 5, the plastic insert 54 being of a shell type. The features basically are the same as shown in FIG. 5, but a smooth, clean, outer surface is provided at 56, the fins having been eliminated. The snap lip feature remains the same as that of FIG. 5.

Figure 8:
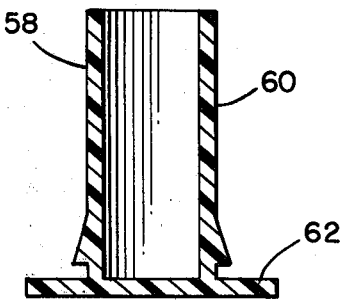
FIG. 8 is a sectional view of a modified form of a plastic insert or component usable in the construction shown in FIG. 5.

A still further modified form of the invention is shown in FIG. 8. In this form, a tubular, open top plastic insert 58 is used. This plastic insert 58 has many of the features of the preceding embodiments shown in FIGS. 5 and 6. Additionally, this insert design, being open, has increased molding ease and, similar to the foregoing embodiments, can be effected with color coding, a smooth clean, outer surface 60, similar to that indicated at 56, being provided and, again, is provided by the base 62 with a maximum integrating or bonding area with a stopper 24. This configuration also permits for rapid mechanical assembly with the metal skirt portion, such as indicated at 42 in FIG. 5.

It is noted that the different structural embodiments of the invention, as shown and described, each incorporate, for example, an upstanding or elongated, relatively narrow, generally tubular or cylindrical, actuating portion, terminating in a substantially flat flange area, and a peripherally larger skirt, the lower edge thereof being adapted to be crimped under the container finish. A conventional rubber stopper, having a plug portion engaged in the opening in the container, is operationally integrated to the upper portion. Adhesive means is provided at their junction point.

The substantially flat flange at the bottom or base of the elongated actuating portion serves the important role of compressing the stopper or closure means to create a seal with the mouth of the container. The overall purpose or result of this construction is that, upon tilting, or tipping, of the cap in the manner shown in broken lines in FIG. 1, it serves to removed the sealing stopper from the access opening as an integrated portion of the composite structure and the access or discharge opening in the container is thereby opened.

While a particular rubber stopper configuration has been shown in the drawings, variations therein will be obvious to those skilled in the art.

In this disclosure, there are shown and described only preferred embodiments of the invention, but as aforementioned, it is to be understood that the invention is capable of changes or modifications within the scope of the inventive concept as expressed herein.

I claim:

1. A composite tip-off type cap operatively adapted for connection to a container having an access opening for closure thereof and sealing contents therein, said composite cap comprising an elongated, narrow exterior top portion, and a bottom, open-ended skirt operatively integrated therewith, said skirt having a lower edge removably attachable to a said container about a said access opening, said composite cap being conjointly removable as an integrated unit from a container, to open the container for access to the liquid therein, by application of a lateral tilting force against the elongated cap exterior at a position thereof remote from connection of the cap to the container, said elongated exterior portion being plastic and having a bottom disc thereon, said skirt being separate from said plastic portion, said skirt including a top portion having an opening therethrough, said plastic exterior portion extending through said opening, said disc being integratedly attached to an interior surface of said skirt top portion to integrate the composite cap parts during assembly.

2. A cap as claimed in claim 1, said disc being adhesively integrated.

3. A composite tip-off type cap as claimed in claim 1, the lower edge of said skirt having a plurality of peripherally spaced scores therein for lowering a required said lateral tilting force to separate said cap from said container.

4. A composite tip-off type cap as claimed in claim 1, further including an interrupted circumferential scoreline in said skirt and constituting a break line to give an indication of attempted pilferage or possible container content contamination.

5. A composite tip-off type cap as claimed in claim 1, said plastic elongated portion having a multiplicity of external ribs thereon.

6. A composite tip-off type cap as claimed in claim 1, further including a snap lip recess between said elongated plastic cap portion and the upper surface of said top portion of said skirt, said recess being coactable with the periphery of said skirt top opening for interengagement of the composite cap portions.

7. A composite tip-off type cap as claimed in claim 1, the exterior of said plastic elongated portion being plain surfaced, further including a snap lip recess between said elongated plastic cap portion and the upper surface of said top portion of said skirt, said recess being coactable with the periphery of said skirt top opening for interengagement of the composite cap portions.

8. A composite tip-off type cap as claimed in claim 1, wherein said elongated plastic portion is hollow.

* * * * *